US011602486B2

(12) United States Patent
Singh et al.

(10) Patent No.: US 11,602,486 B2
(45) Date of Patent: Mar. 14, 2023

(54) DEVICE FOR CHILLING INSULIN IN A TRAVEL MUG

(71) Applicants: Daniel Singh, Fort Lauderdale, FL (US); Salloome Singh, Fort Lauderdale, FL (US)

(72) Inventors: Daniel Singh, Fort Lauderdale, FL (US); Salloome Singh, Fort Lauderdale, FL (US)

( * ) Notice: Subject to any disclaimer, the term of this patent is extended or adjusted under 35 U.S.C. 154(b) by 38 days.

(21) Appl. No.: 17/362,835

(22) Filed: Jun. 29, 2021

(65) Prior Publication Data

US 2022/0409486 A1 Dec. 29, 2022

(51) Int. Cl.

| | |
|---|---|
| ***F25D 3/00*** | (2006.01) |
| ***F25D 3/08*** | (2006.01) |
| ***A61J 1/16*** | (2006.01) |
| ***B65D 81/18*** | (2006.01) |

(52) U.S. Cl.

CPC ..... *A61J 1/165* (2013.01); *B65D 81/18* (2013.01); *A61J 2200/44* (2013.01); *A61J 2200/72* (2013.01)

(58) Field of Classification Search

CPC ... A47G 19/2288; A61J 1/165; A61J 2200/40; A61J 2200/50; A61J 2200/44; A61J 2200/72; A61J 1/16; A61M 2205/127; A61M 5/002; B65D 81/18; B65D 81/3827; B65D 79/02; F25D 2303/0831; F25D 2303/081; F25D 2303/803; F25D 2303/809; F25D 2303/0845; F25D 2331/804; F25D 2400/36; F25D 3/08; F25D 31/007; F25D 3/06; F25D 2331/8014; F25D 2331/803; F25D 2331/0842; F25D 2331/0843

USPC ..... 206/570; 62/130, 457.2

See application file for complete search history.

(56) References Cited

U.S. PATENT DOCUMENTS

| | | | | | |
|---|---|---|---|---|---|
| 2,032,130 | A * | 2/1936 | Jurkat | F25D 3/14 | 62/466 |
| 2,738,890 | A * | 3/1956 | Dahl | F25D 3/08 | 215/6 |
| 2,915,640 | A * | 12/1959 | Grubel | G21F 5/015 | 220/796 |
| 3,168,362 | A * | 2/1965 | Perkins | F17C 3/02 | 62/48.1 |
| 4,138,027 | A | 2/1979 | Frye et al. | | |
| 4,250,998 | A * | 2/1981 | Taylor | A45C 11/20 | 220/592.01 |
| 4,343,158 | A | 8/1982 | Campbell | | |
| 4,446,970 | A * | 5/1984 | Further | A61M 5/002 | 206/569 |
| 4,474,033 | A * | 10/1984 | Baker | F25D 3/08 | 62/457.2 |

(Continued)

*Primary Examiner* — Gideon R Weinerth

(74) *Attorney, Agent, or Firm* — Derek Fahey; The Plus IP Firm, PLLC

(57) ABSTRACT

A device for use with a travel mug for storing and chilling at least one vial is disclosed. The device generally comprises at least a first cylindrical portion having a top end and a bottom end, wherein the top end comprises at least one recessed portion for storing the at least one vial and a second cylindrical portion having a top end and a bottom end. In one embodiment, the device comprises a rod having a first end connected to the bottom end of the first cylindrical portion, and a second end connected to the top end of the second cylindrical portion.

16 Claims, 8 Drawing Sheets

(56) References Cited

U.S. PATENT DOCUMENTS 4,649,714 A * 3/1987 Lee ..... F25D 3/06 62/258
4,848,587 A 7/1989 Nipp
4,910,977 A * 3/1990 Hilton ..... A45C 11/20 D7/608
4,947,658 A * 8/1990 Wheeler ..... F25D 3/06 62/457.2
4,951,482 A * 8/1990 Gilbert ..... F25D 3/08 62/306
4,955,480 A * 9/1990 Sexton ..... F25D 3/08 62/372
5,116,578 A 5/1992 Baxter
5,181,394 A * 1/1993 Schea, III ..... A61J 1/165 D24/227
5,934,099 A * 8/1999 Cook ..... A61J 1/165 62/457.2
5,956,968 A * 9/1999 Grabowski ..... F25D 3/08 62/457.2
6,044,650 A * 4/2000 Cook ..... F25D 3/08 62/130
6,062,398 A * 5/2000 Thalmayr ..... B65G 51/06 211/74
6,324,864 B1 * 12/2001 Stewart ..... G09F 23/08 62/530
6,361,746 B1 * 3/2002 Wlodarski ..... B01L 7/00 422/561
6,381,981 B1 * 5/2002 Yaddgo ..... A61B 50/00 62/457.2
6,467,299 B1 * 10/2002 Coetzee ..... A61J 1/165 62/530
7,073,678 B1 7/2006 Dibdin et al.
7,100,393 B2 * 9/2006 D'Angelo ..... F25D 31/007 62/457.2
7,861,552 B1 * 1/2011 Hughes ..... A45C 13/02 62/457.2
8,616,390 B2 12/2013 Kountotsis
9,151,531 B2 10/2015 Wengreen et al.
9,549,627 B1 * 1/2017 Grady ..... A47G 23/0208
9,566,380 B1 * 2/2017 Tcholakian ..... A61J 1/16
9,707,156 B2 * 7/2017 Wengreen ..... F25D 3/08
2005/0016895 A1 * 1/2005 Glenn ..... A61J 1/165 206/570
2006/0081750 A1 * 4/2006 Kazyaka ..... B60N 3/107 248/311.2
2006/0196882 A1 * 9/2006 Shimazaki ..... F25D 3/08 220/737
2007/0190518 A1 * 8/2007 Bourgeois ..... A01N 1/0273 435/1.1
2007/0210090 A1 * 9/2007 Sixt ..... A01N 1/0273 220/592.03
2008/0272131 A1 * 11/2008 Roberts ..... G01K 1/024 374/E1.004
2010/0282762 A1 11/2010 Leonard
2012/0193366 A1 * 8/2012 Miller ..... B65D 81/3879 220/592.24
2012/0325826 A1 * 12/2012 McCormick ..... F25D 3/06 220/592.01
2013/0240537 A1 * 9/2013 McCormick ..... B65D 81/3888 220/592.2
2014/0001188 A1 * 1/2014 Nahm ..... A61J 1/165 126/400
2015/0327704 A1 * 11/2015 Malinowski ..... F25C 1/22 249/163
2018/0306651 A1 10/2018 Mitchell et al.
2021/0369945 A1 * 12/2021 Otten ..... A61M 5/008

* cited by examiner

DEVICE FOR CHILLING INSULIN IN A TRAVEL MUG

TECHNICAL FIELD

The present invention relates to systems and methods for storing and chilling insulin. In particular, the present invention relates to a device that is combined with a travel mug to realize a system for chilling insulin.

BACKGROUND

Diabetes is one of the most prevalent diseases in the United States today. For instance, in 2018 nearly 34.2 million Americans (10.5% of the population) have diabetes, of which 26.8 million were diagnosed. In 2017, diabetes was the seventh leading cause of death in the United States based on 83,564 death certificates.

Insulin is an anabolic peptide hormone produced by beta cells in the pancreas. Insulin is responsible for regulating, at least in part, the metabolism of macronutrients (carbohydrates, fats, and protein). In particular, insulin is responsible for promoting the absorption of glucose from the blood into the liver fat and skeletal muscle cells. Diabetes is a disease in which your blood glucose levels are too high, which can cause serious health problems. In type 1 diabetes, the body does not produce insulin. With type 2 diabetes (more common), the body does not make or use insulin as well as a healthy person.

Insulin was discovered at the University of Toronto in 1921. The first treatment for a diabetic with insulin was made in 1922. Ever since, insulin has been a crucial drug for the treatment of the effects of diabetes. However, insulin must be stored at a refrigerated temperature prior to use. When insulin is actively being used by a diabetic, it must be kept at a temperature of around 36-86° F., and most preferably in the 36-46° F. range.

Many storage devices for insulin exist. However, many of them are costly and perhaps more importantly, lack discretion. Thus, there exists a need in the art for a device for chilling insulin that lowers costs and increases discretion.

SUMMARY

A device for use with a travel mug for storing and chilling at least one vial is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a device for use with a travel mug for storing and chilling at least one vial is disclosed. In one embodiment, the device comprises (a) a first base portion (e.g., a first cylindrical portion) having a top end and a bottom end, wherein the top end comprises at least one recessed portion for storing the at least one vial and (b) a rod having a first end connected to the bottom end of the first cylindrical portion, and a second end. In one embodiment, the device comprises a second base portion (e.g., a second cylindrical portion) having a top end and a bottom end, wherein the second end of the rod is connected to the top end of the second cylindrical portion. In one embodiment, the second cylindrical portion has a diameter roughly equivalent to a size of a bottom of the travel mug, such that the second cylindrical portion fits securely into the travel mug.

In one embodiment, both the first end and the second end of the rod each comprise a threading. In one embodiment, the bottom end of the first cylindrical portion comprises at least one recessed portion for receiving and threading the first end of the rod, and wherein the top end of the second cylindrical portion comprises at least one recessed portion for receiving and threading the second end of the rod. In one embodiment, the first cylindrical portion comprises three recessed portions for storing three individual vials. In one embodiment, the first cylindrical portion comprises at least one bored portion, wherein the at least one bored portion allows for cool air to circulate from below the first cylindrical portion to above the first cylindrical portion. In one embodiment, the rod has a length such that the top end of the first cylindrical portion is proximate to an opening of the travel mug when in use. In one embodiment, the rod enables a user to place ice cubes in the travel mug between the first cylindrical portion and a second cylindrical portion to provide chilling.

In one embodiment, a kit comprises the aforementioned first cylindrical portion, second cylindrical portion, and rod. In one embodiment, in a fully assembled condition, the first cylindrical portion, the second cylindrical portion, and the rod form a device for use with a travel mug for storing and chilling at least one vial.

In one embodiment, the device comprises a thermostat attachment for monitoring a temperature within the travel mug.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1A:
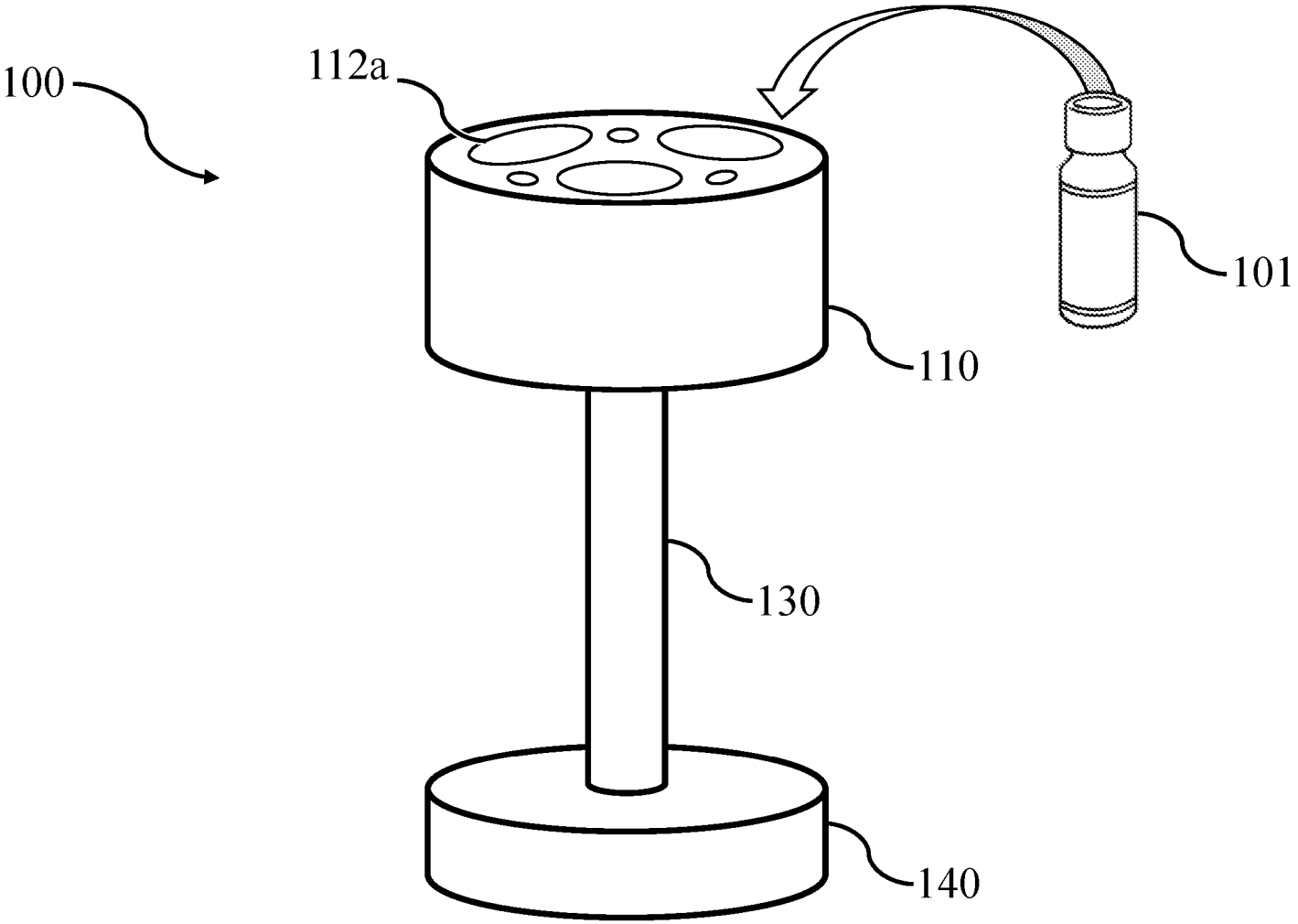
FIG. 1*a* is a perspective view of a device for use with a travel mug for storing and chilling at least one vial (e.g., of insulin), according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a device for use with a travel mug for storing and chilling vials (e.g., of insulin). The disclosed embodiments improve upon the problems with the prior art by providing a lower cost and significantly more discrete device for storing and chilling insulin.

Figure 1B:
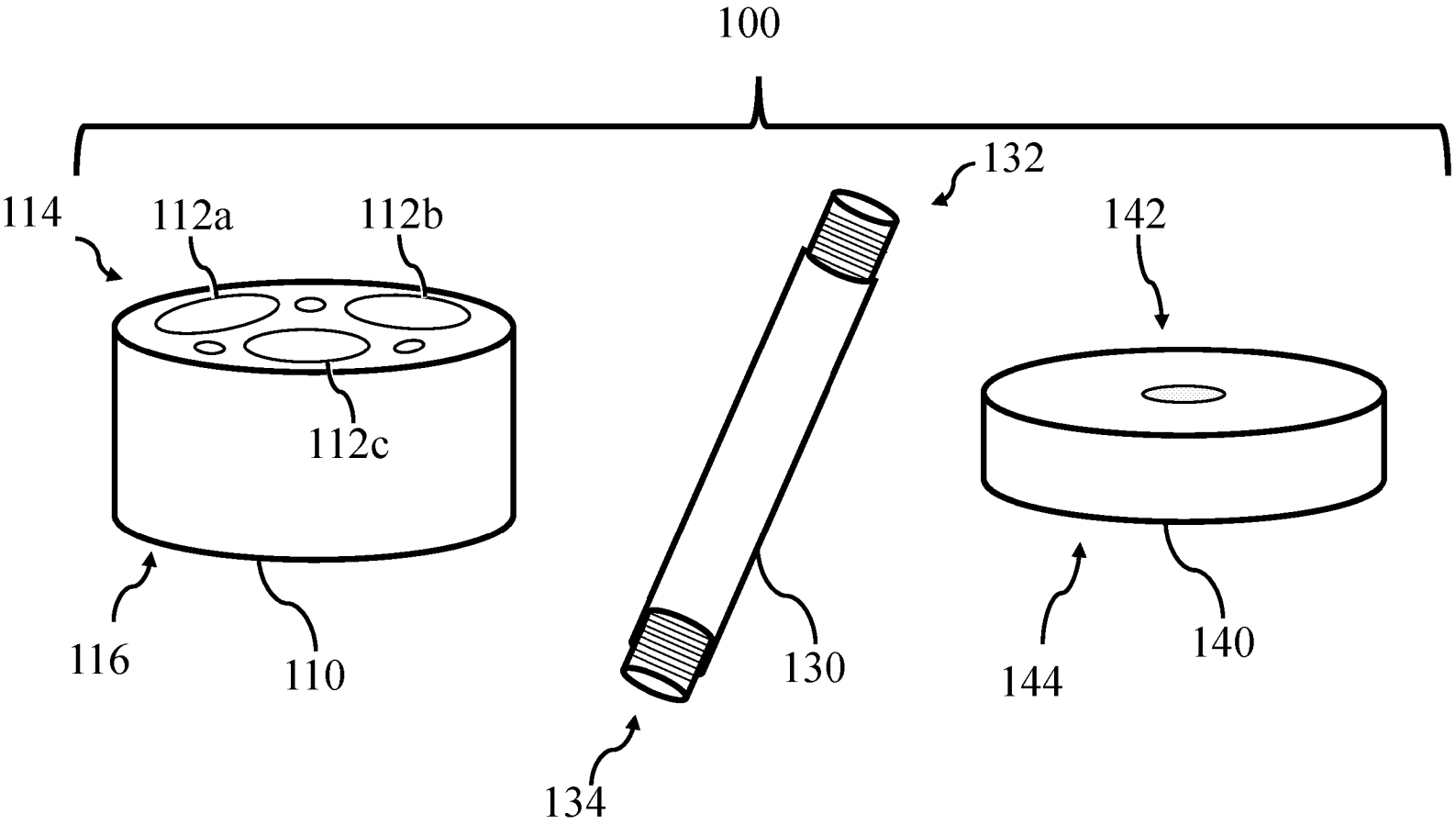
FIG. 1*b* is an exploded, deconstructed view of a device for use with a travel mug for storing and chilling at least one vial, according to an example embodiment.

Referring now to the figures, and with reference to FIGS. 1*a*-1*b* in particular, a device (100) for use with a travel mug for storing and chilling at least one vial (101) is shown. As illustrated, the device comprises (a) a first base portion (110) having a top end (114) and a bottom end (116), (b) a second base portion (140) having a top end and a bottom end, and (c) a rod (130) having a first end connected to the bottom end of the first base portion (110), and a second end connected to the top end of the second base portion (140). The first base portion (110) and second base portion (140) are depicted as cylindrical portions. However, it is also understood that other shapes (such as triangular, rectangular, square etc.) may be used, and are within the spirit and scope of the present invention.

Figure 2A:
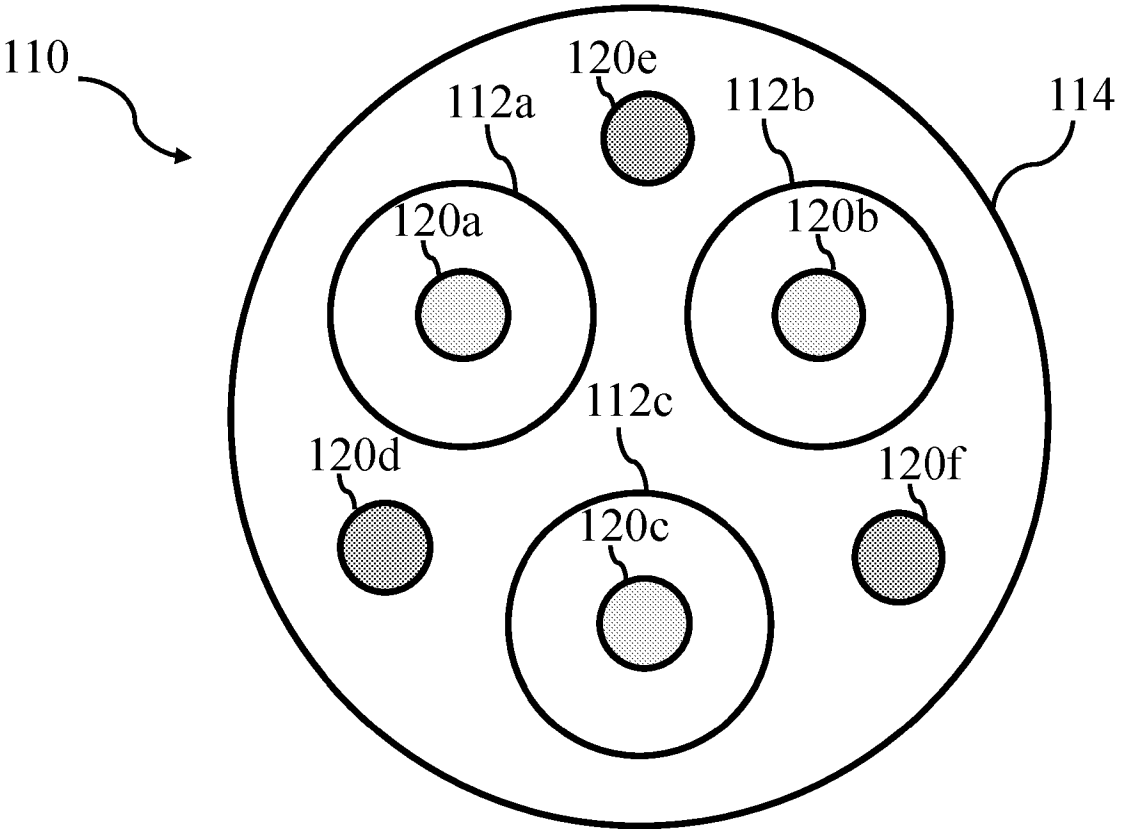
FIG. 2*a* is a top view of a first cylindrical portion of a device for use with a travel mug for storing and chilling at least one vial, according to an example embodiment.

As noted above, the device generally includes a first base portion, such as a first cylindrical portion. When in use, the first cylindrical portion is generally near the top of the travel mug, such that the user can readily access the stored vial(s). A top view of an embodiment of a first cylindrical portion (110) is shown by FIG. 2*a*. As illustrated, the comprises three recessed portions (112*a*-112*c*) for storing three individual vials (101). The recessed portions are made into the top end (114) of the first cylindrical portion (110). The recessed portions may be sized and shaped such that a standard insulin vial fits tightly into the recessed portion.

The first base portion also may include one or more bored portions (120*a*-120*f*). In the illustrated embodiment, the bored portions (120*a*-120*f*) may allow for cool air to circulate from below the first cylindrical portion (110) to above the first cylindrical portion (110). In contrast to the recessed portions, the bored portions are holes inside the first cylindrical portion (110), which enables air flow. The recessed portions (112*a*-112*c*) may each include one or more bored portions (120*a*-120*c*) to allow cool air to contact the bottom of the stored vials. One or more bored portions (120*d*-120*f*) may be positioned on the peripherals of the recessed portions (112*a*-112*c*) to allow cool air to circulate above the stored vials. In this way, the bored portions (120*a*-120*f*) enable cooling of the stored vials.

Figure 4:
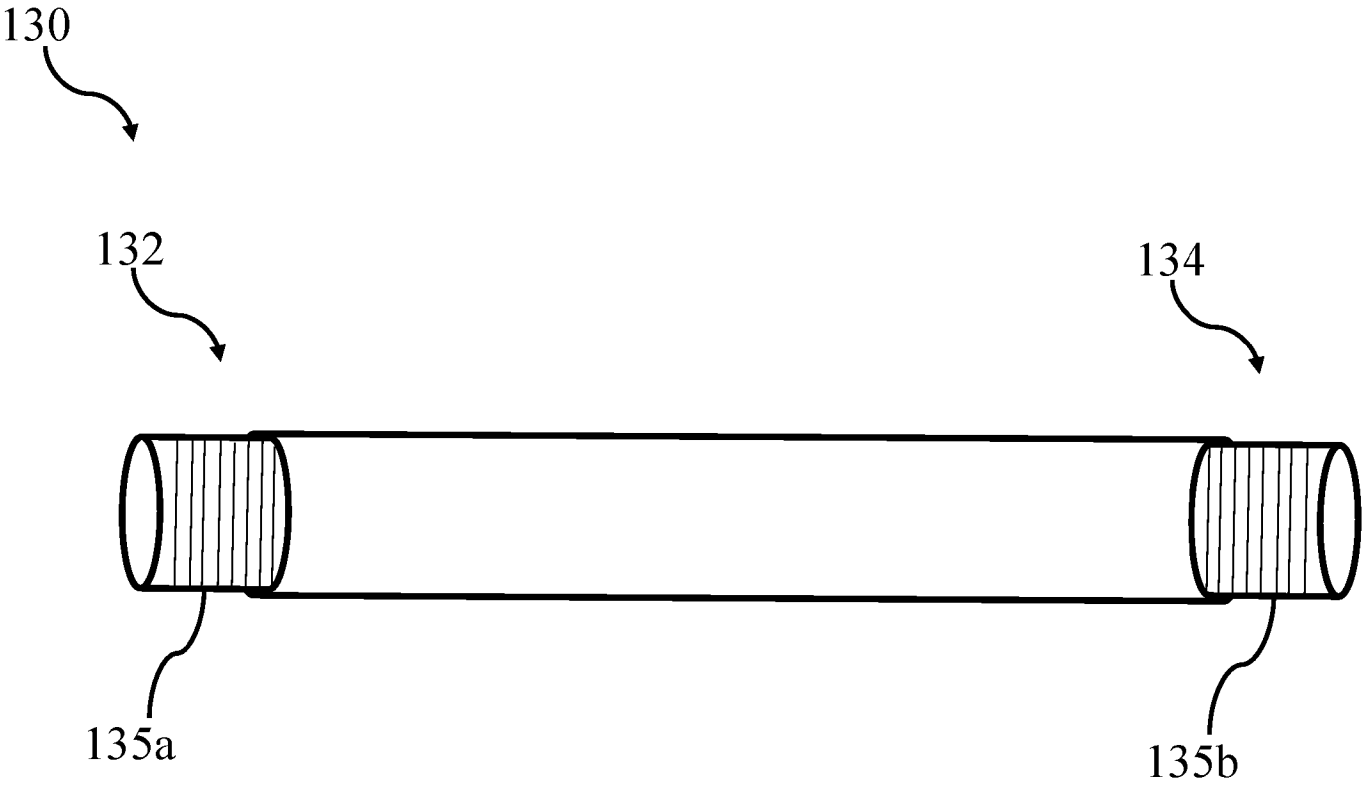
FIG. 4 is a perspective view of a rod of a device for use with a travel mug for storing and chilling at least one vial, according to an example embodiment.

With reference to the figures now including FIG. 4, the first base portion (110) and second base portion (140) may be connected via an elongated object, such as a rod (130). The rod may connect the first cylindrical portion (110) and the second cylindrical portion (140) in any practicable manner. For instance, the rod (130) may permanently be affixed to the cylindrical portions (110, 140). Alternatively, the rod (130) may be attachable to the cylindrical portions (110, 140). In one embodiment, the first end (132) and the second end (134) of the rod (130) each comprise a threading (135*a*, 135*b*). In this regard, the components (110, 130, 140) of the invention may be provided as a kit.

Figure 2B:
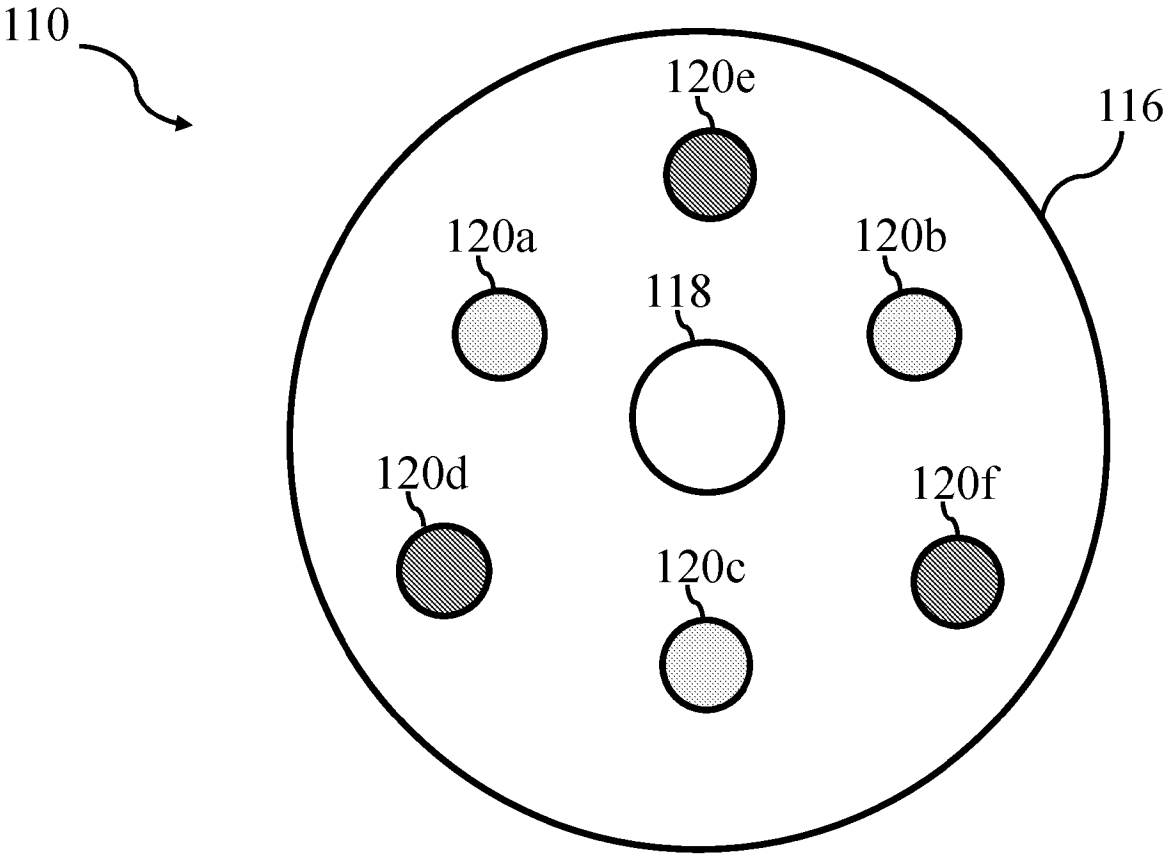
FIG. 2*b* is a bottom view of a first cylindrical portion of a device for use with a travel mug for storing and chilling at least one vial, according to an example embodiment.
Figure 3:
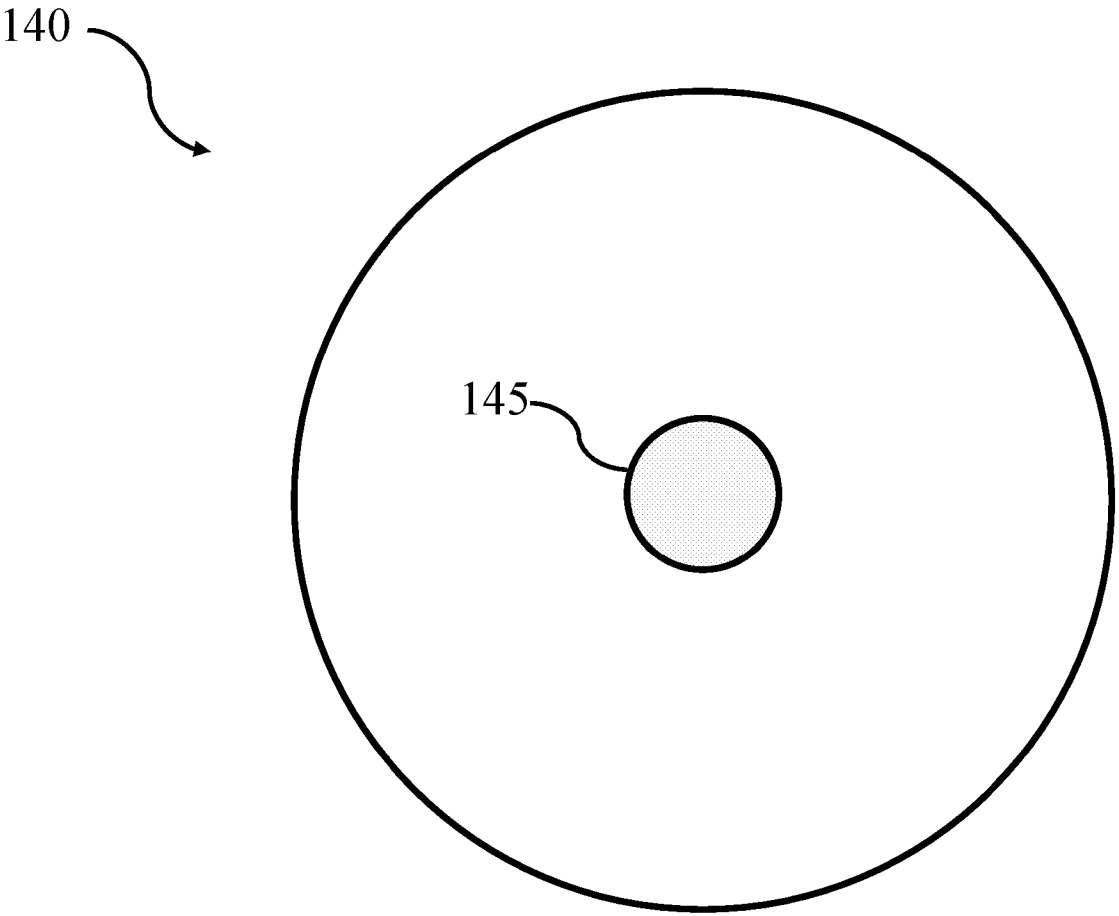
FIG. 3 is a top view of a second cylindrical portion of a device for use with a travel mug for storing and chilling at least one vial, according to an example embodiment.

A bottom view of the first cylindrical portion (110) is shown in FIG. 2*b*. As illustrated, the bottom end (116) of the first cylindrical portion (110) comprises at least one recessed portion (118) for receiving the first end (132) of the rod (130). A top view of a second cylindrical portion (140) is shown in FIG. 3. As illustrated, the top end (142) of the second cylindrical portion (140) comprises at least one recessed portion (145) for receiving the second end of the rod (134). The recessed portion (145) for receiving the rod (130) may also be a bored portion, such that the top end (142) and bottom end (144) are symmetrical. In one embodiment, the recessed portions (118, 145) for receiving the rod (130) each comprise a female threading for threading the male threading (135*a*, 135*b*) of the rod (130).

Figure 1D:
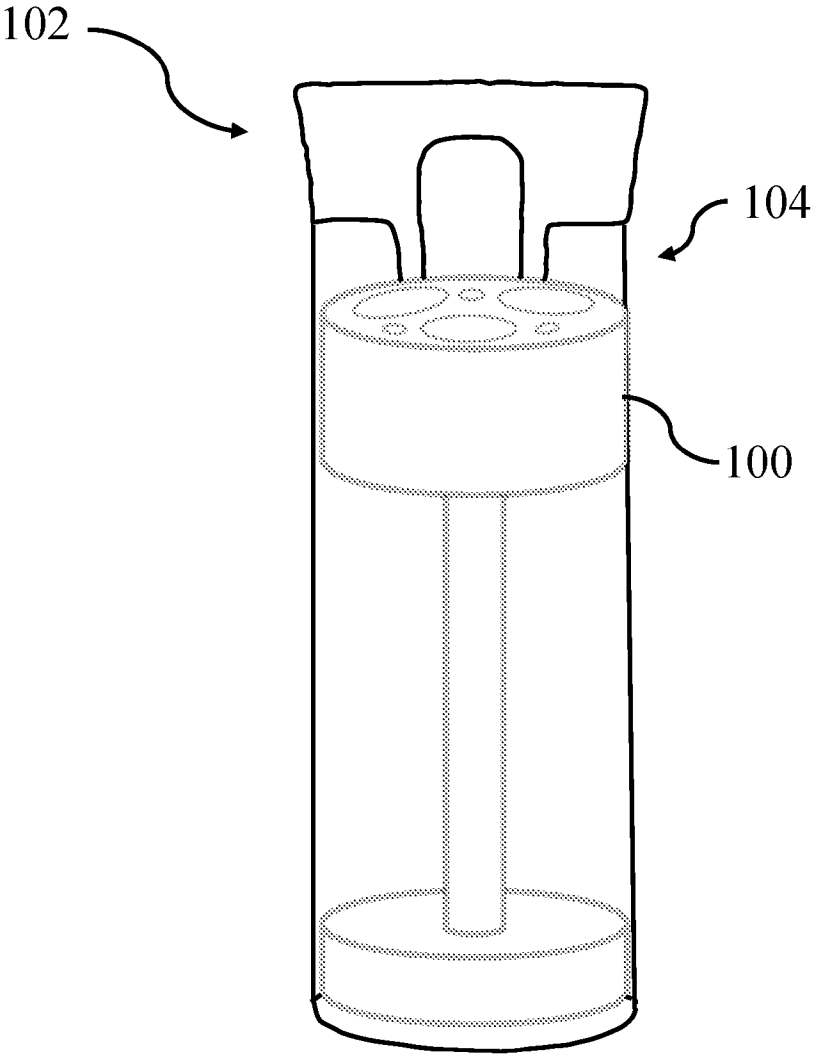
FIG. 1*d* is a cutaway view of the travel mug of FIG. 1*c* with the device for storing and chilling insulin therein, according to an example embodiment.
Figure 1C:
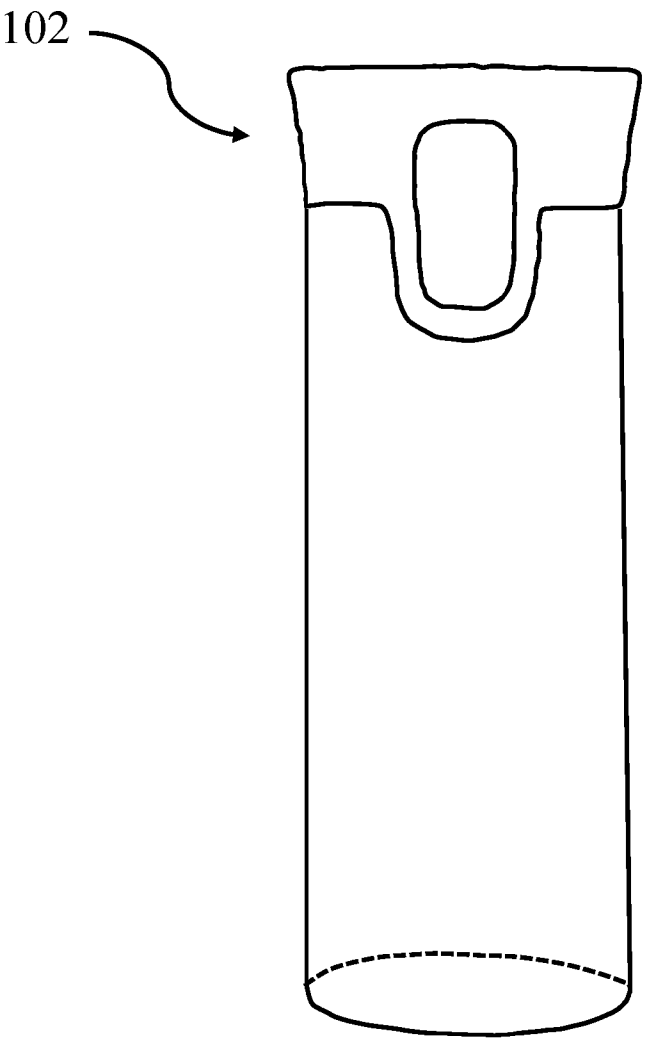
FIG. 1*c* is a side view of an exemplary travel mug for use with the device for storing and chilling at least one vial, according to an example embodiment.

An embodiment of a travel mug (102) for use with the device (100) is shown in FIG. 1*c*. As shown in subsequent figure FIG. 1*d*, the device (100) is shown in the cutaway view of the travel mug (102). As illustrated, the device (100) has a size and shape such that it can fit securely into the travel mug (102). Furthermore, the second cylindrical portion (140) has a diameter roughly equivalent to a size of a bottom of the travel mug (102), such that the second cylindrical portion (140) fits securely into the travel mug (102).

In one embodiment, the device (100) has a size and shape for use with a 20-ounce CONTIGO® Travel Mug. However, the device (100) may be fashioned in a plurality of dimensions to accommodate any size of travel mug. In this embodiment, the diameter of the first cylindrical portion (110) is approximately 2.5 inches (2.465 inches). In this embodiment, a length of the rod is approximately 5.8 inches. In this embodiment, the recessed portion on the bottom end of the first cylindrical portion has a depth of about 0.5 inches. In this embodiment, the recessed portion on the top end of the second cylindrical portion has a depth of about 0.75 inches. In this embodiment, the diameter of the bored portions inside the recessed portions for storing the vials is about 0.4 inches. In this embodiment, the bored portions (outside of the recessed portions) have a diameter of about 0.3 inches. In this embodiment, the depth of the recessed portions for storing vials is about 0.7 inches. In this embodiment, the thickness of the first cylindrical portion (i.e., from top end to bottom end) is about 1.5 inches. In this embodiment, the thickness of the second cylindrical portion (i.e., from top end to bottom end) is about 0.76 inches.

The length of the device (100) is generally determined by the length of the rod (130). For instance, the rod may be interchangeable to accommodate multiple different travel mugs (102) according to the preference of the user. In general, the rod (130) has a length such that the top end of the first cylindrical portion (110) is proximate to an opening (104) of the travel mug (102) when in use.

Figure 1E:
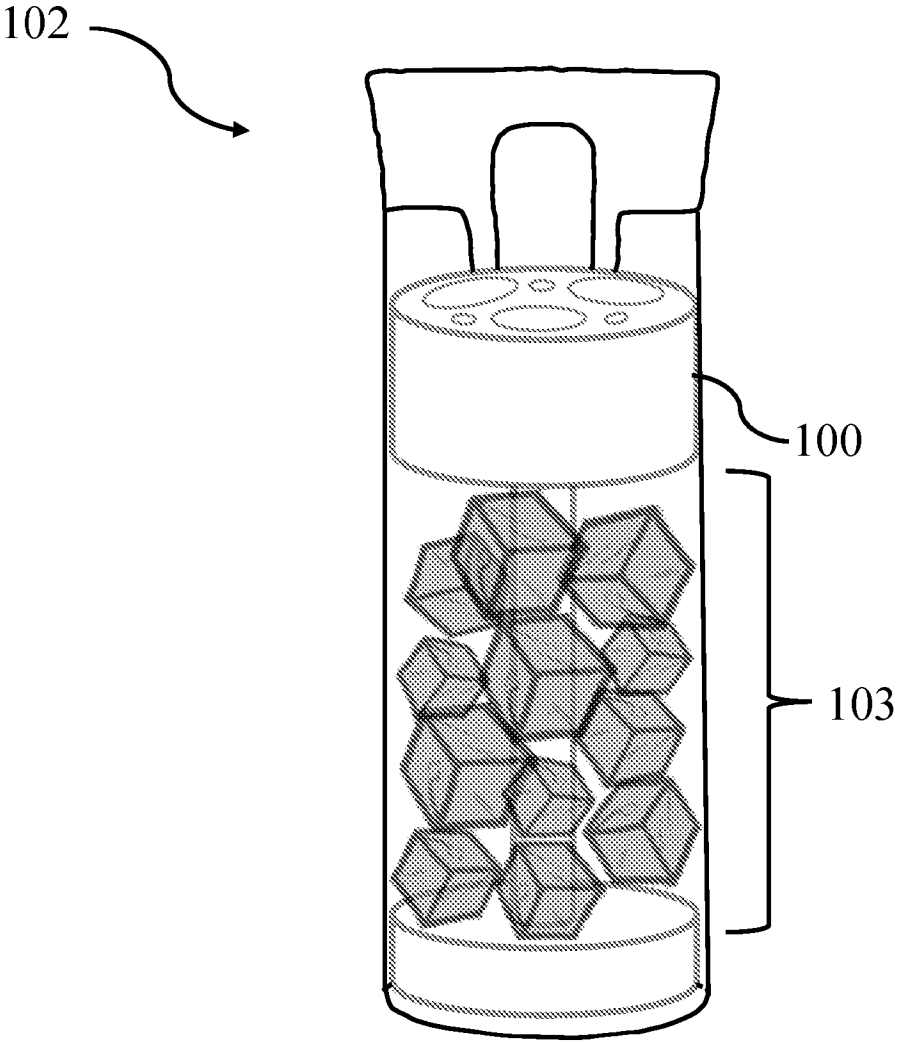
FIG. 1*e* is a cutaway view of the travel mug and device of FIG. 1*d* with a plurality of ice cubes therein to provide chilling, according to an example embodiment.

As shown in FIG. 1*e*, the use of the rod (130) in connection with the first cylindrical portion (110) and second cylindrical portion (140) enables the user to place ice cubes (103) in the travel mug (102) between the first cylindrical portion (110) and a second cylindrical portion (140) to provide chilling.

In another aspect of the invention, the device (100) may comprise a thermostat attachment (not illustrated) for monitoring a temperature within the travel mug (102). The thermostat may be embedded in the first cylindrical portion (110) and may provide an electronic readout of the temperature inside the travel mug when in use. The thermostat may also provide an external reading (i.e., on the outside of the travel mug).

The device (100) may be comprised of any suitable material. For instance, the device (100) may be comprised of a polymeric material (e.g., a thermoplastic), a metal or metal alloy, and combinations thereof. In a preferred embodiment, the device (100) is made from a polymeric material. In this regard, the device (100) may be manufactured by any suitable means, such as by a molding process (e.g., injection molding), additive manufacturing, and reductive manufacturing methods such as CNC machining. Other manufacturing methods are also within the spirit and scope of the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A device for use with a travel mug for storing and chilling at least one vial, the device comprising: (a) a first base portion having a top end and a bottom end, wherein the top end comprises at least one recessed portion for storing the at least one vial; (b) a second base portion having a top end and a bottom end; and (c) a rod having a first end connected to the bottom end of the first base portion and a second end connected to the top end of the second base portion.

2. The device of claim 1, wherein the first base portion is a first cylindrical portion, and wherein the second base portion is a second cylindrical portion.

3. The device of claim 2, wherein the second cylindrical portion has a diameter roughly equivalent to a size of a bottom of the travel mug, such that the second cylindrical portion fits securely into the travel mug.

4. The device of claim 3, wherein both the first end and the second end of the rod each comprise a threading.

5. The device of claim 4, wherein the bottom end of the first cylindrical portion comprises at least one recessed portion for receiving and threading the first end of the rod, and wherein the top end of the second cylindrical portion comprises at least one recessed portion for receiving and threading the second end of the rod.

6. The device of claim 2, wherein the first cylindrical portion comprises three recessed portions for storing three individual vials.

7. The device of claim 2, wherein the first cylindrical portion comprises at least one bored portion, wherein the at least one bored portion allows for cool air to circulate from below the first cylindrical portion to above the first cylindrical portion.

8. The device of claim 2, wherein the rod has a length such that the top end of the first cylindrical portion is proximate to an opening of the travel mug when in use.

9. The device of claim 2, wherein the rod enables a user to place ice cubes in the travel mug between the first cylindrical portion and the second cylindrical portion to provide chilling.

10. A device for use with a travel mug for storing and chilling at least one vial, the device comprising: (a) a first cylindrical portion having a top end and a bottom end, wherein the top end comprises at least one recessed portion for storing the at least one vial; (b) a second cylindrical portion having a top end and a bottom end; (c) a rod having a first end connected to the bottom end of the first cylindrical portion, and a second end connected to the top end of the second cylindrical portion, wherein: (i) the rod has a length such that the top end of the first cylindrical portion is proximate to an opening of the travel mug when in use; and (ii) the rod enables a user to place ice cubes in the travel mug between the first cylindrical portion and the second cylindrical portion to provide chilling.

11. The device of claim 10, wherein the second cylindrical portion has a diameter roughly equivalent to a size of a bottom of the travel mug, such that the second cylindrical portion fits securely into the travel mug.

12. The device of claim 10, wherein the first cylindrical portion comprises three recessed portions for storing three individual vials.

13. The device of claim 10, wherein both the first end and the second end of the rod each comprise a threading.

14. The device of claim 13, wherein the bottom end of the first cylindrical portion comprises at least one recessed portion for receiving and threading the first end of the rod, and wherein the top end of the second cylindrical portion comprises at least one recessed portion for receiving and threading the second end of the rod.

15. The device of claim 10, wherein the first cylindrical portion comprises at least one bored portion, wherein the at least one bored portion allows for cool air to circulate from below the first cylindrical portion to above the first cylindrical portion.

16. A kit comprising: (a) a first cylindrical portion having a top end and a bottom end, wherein the top end comprises at least one recessed portion for storing at least one vial; (b) a second cylindrical portion having a top end and a bottom end; (c) a rod having a first end connected to the bottom end of the first cylindrical portion, and a second end connected to the top end of the second cylindrical portion; wherein in a fully assembled condition, the first cylindrical portion, the second cylindrical portion, and the rod form a device for use with a travel mug for storing and chilling the at least one vial; wherein in use with the travel mug: (i) the rod has a length such that the top end of the first cylindrical portion is proximate to an opening of the travel mug; and (ii) the rod enables a user to place ice cubes in the travel mug between the first cylindrical portion and the second cylindrical portion to provide chilling.

* * * * *